US006975738B2

(12) United States Patent
Yang et al.

(10) Patent No.: US 6,975,738 B2
(45) Date of Patent: Dec. 13, 2005

(54) TELEVISION SYSTEM WITH DIGITAL SOUND

(75) Inventors: Fuzhong Yang, Shenzhen (CN); Fayong Cai, Shenzhen (CN)

(73) Assignee: TCL King Electronics (Shenzhen) Co., Ltd.

( * ) Notice: Subject to any disclaimer, the term of this patent is extended or adjusted under 35 U.S.C. 154(b) by 473 days.

(21) Appl. No.: 09/783,371

(22) Filed: Feb. 14, 2001

(65) Prior Publication Data

US 2001/0028723 A1 Oct. 11, 2001

(30) Foreign Application Priority Data

Feb. 18, 2000 (CN) ..... 00205760 U

(51) Int. Cl.[7] ..... H04R 5/02

(52) U.S. Cl. ..... 381/306; 348/738; 348/633; 348/634

(58) Field of Search ..... 381/306, 304, 381/333, 99, 388; 348/738, 633, 634; 181/199

(56) References Cited

U.S. PATENT DOCUMENTS 5,999,229 A * 12/1999 Samarughi et al. ..... 348/634

FOREIGN PATENT DOCUMENTS

| | | | | |
|---|---|---|---|---|
| JP | 359201600 A | * | 11/1984 | ..... H04S 1/00 |
| JP | 360025392 A | * | 2/1985 | ..... H04N 5/455 |
| JP | 402076382 A | * | 3/1990 | ..... H04N 5/64 |
| JP | 402312370 A | * | 12/1990 | ..... H04N 5/60 |
| JP | JP404054076 A | * | 2/1992 | ..... H04N 5/60 |
| JP | 06-105257 | * | 4/1994 | ..... H04N 5/64 |

* cited by examiner

*Primary Examiner*—Melur Ramakrishnajah
(74) *Attorney, Agent, or Firm*—Wood, Phillips, Katz, Clark & Mortimer

(57) ABSTRACT

A television system of digital sound includes a color television and at least one pair of three-stage frequency-splitting column sound boxes with each having three speakers. A front digital processor and a power amplifier are arranged in the control circuit of the color television. Its accompanying sound outputs of a stereo are coupled respectively to the pair sound box or build it in the sound box. The system may provide television with Hi-fi stereo or serve as a sound equipment for receiving sound, perfectly reproducing various sound field effects when the scanning system of color television is turned off to save energy and effectively lengthen life of the kinescope and scanning sector.

1 Claim, 5 Drawing Sheets

TELEVISION SYSTEM WITH DIGITAL SOUND

TECHNICAL FIELD

The present invention relates to an audio/visual apparatus, in particular, a digital sound television system that uses a color television to produce digital sound.

BACKGROUND

For many years, television is a product that is mainly used to process visual frequency to present pictures; its accompanying sound system is a subordinate function and cannot be used independently. Along with rapid development of audio/visual technology, more and more audio/visual products enter into ordinary families. Most users have both color television and disk player. However, many users hope to appreciate Hi-fi music with color television set at their leisure, such as CD music, even no sound equipment is equipped with the television, but prior art color television cannot do it.

DESCRIPTION

The present invention is to provide a digital sound television system that may generate digital sound with a color television.

The present invention includes a color television and at least a pair of three-stage frequency-splitting column sound boxes with three speakers. The present invention is characterized that the digital sound television system includes a front amplifier arranged in the control circuit inside the color television and the accompanying sound of the stereo is outputted to at least one pair of the column sound boxes by a power amplifier already in the color television.

A plurality of speakers of the pair of column sound boxes may be built in the color television to form integral speaker device.

The integral speakers may be those for a surrounding stereo sound box.

The present invention is characterized that the color television system integrates visual frequency and digital sound technologies. In addition to be an accompanying sound system of the television, the color television system may be served as independent sound equipment. Meanwhile, the scanning section of the color television may be turned off to stop operation of deflection and high-voltage units, thereby saving energy, maintaining and extending the life of the CRT and the control circuit of its scanning section. The digital sound color television system reproduces various sound field effects perfectly once it is coupled to disk players such as CD, VCD, SVCD, DVD, and digital recorder. It is a modem product integrating color television and digital sound equipment.

The advantage of the digital sound color television system are to digitalize accompanying system of a color television to provide a Hi-fi sound effect; to serve as family audio equipment independently even the CRT is shut down; saves space and render simple operation in comparison with prior art combination sound equipment; to greatly enhance source-sharing rate; and to bring into full use of room space.

BRIEF ILLUSTRATION OF DRAWINGS

Detailed explanation of the structure, characteristics, and functions of the present invention is given in combination with attached drawings.

PREFERRED EMBODIMENTS

Figure 1:
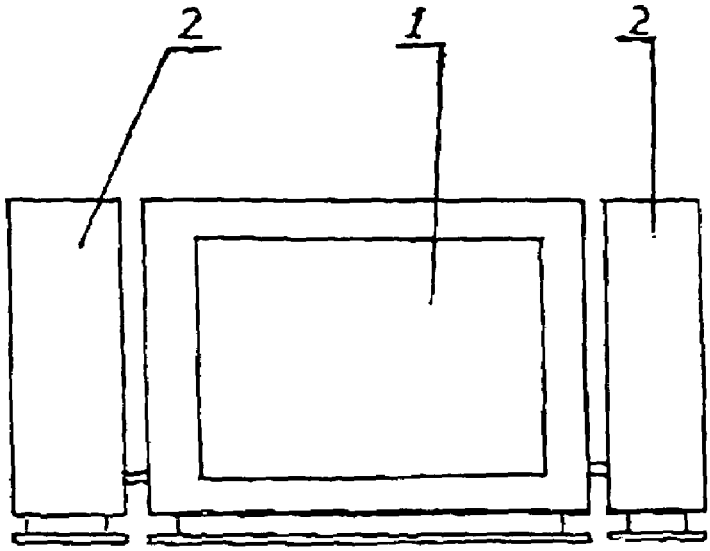
FIG. 1 is a front view of the first embodiment of the present invention.
Figure 2:
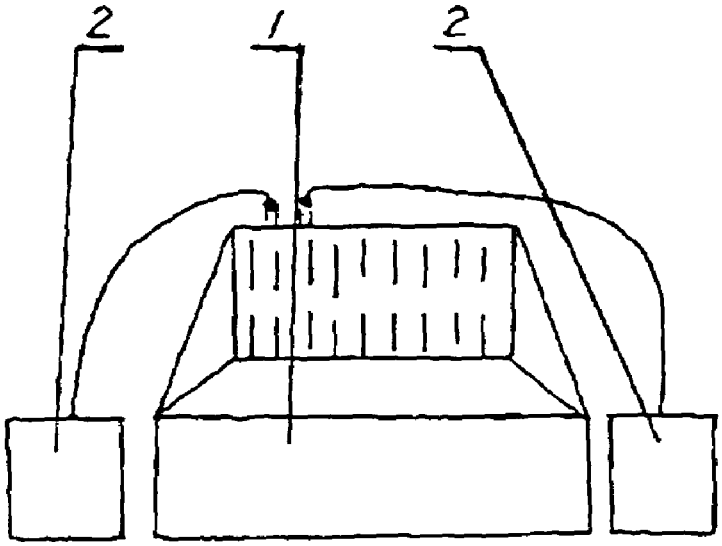
FIG. 2 is a top view of the first embodiment of the present invention.
Figure 5:
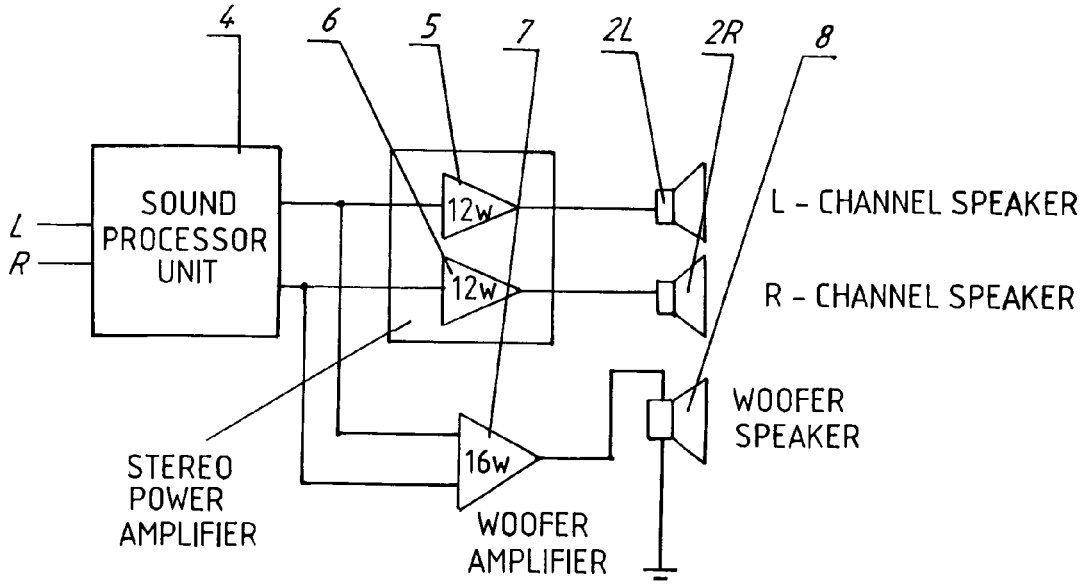
FIG. 5 is a block diagram of the present invention.

FIGS. 1, 2, and 5 show a front view and a top view of the external sound box of first embodiment in accordance with the present invention. The present invention includes color television 1 and at least one pair of three-stage frequency-splitting column sound boxes 2 that are arranged on both sides of the color television with each having three speakers. A front amplifier 4 is arranged in the control circuit in the color television 1 for digital signal processing, such as pitch control over sound signal. The sound signal from the color television or other sources is amplified by amplifier 5 for left channel, power amplifier 6 for right channel (maximum amplification value of each amplifier is 12W), and a woofer amplifier 7 (maximum amplification value of the amplifier is 16W). The amplified sound signal then is coupled to the pair of three-stage frequency-splitting column stereo boxes 2 arranged outside color television 1. The sound boxes may be built in inside or outside.

Figure 3:
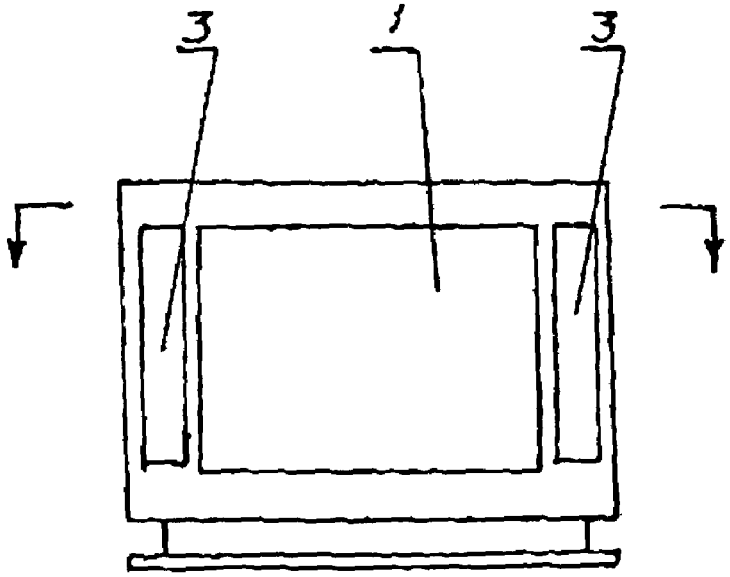
FIG. 3 is a front view of the second embodiment of the present invention.
Figure 4:
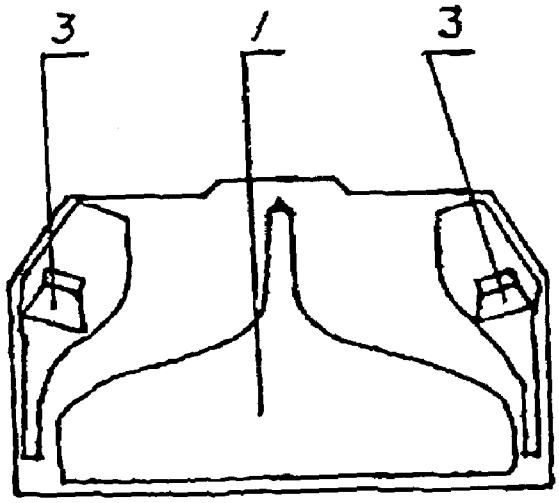
FIG. 4 is a sectional view along line A-A of the second embodiment of the present invention.

FIGS. 3 and 4 show a front view and sectional view along A—A line of the second embodiment of the present invention. A pair of speakers is built in the color television 1. Thus, a compact space is provided and the integral speakers may be those for surrounding stereo. The control circuit of the second embodiment is almost the same with that of the first embodiment, e.g., a front amplifier 4 is arranged in the control circuit of color television 1 for digital signal processing, such as pitch control over sound signal. The sound signal from the color television or other sources is amplified by power amplifier 5 for left channel, power amplifier 6 for right channel, and a woofer amplifier 7. The amplified sound signal is then coupled to the pair of three-stage frequency-splitting column stereo boxes in the color television 1, as shown in FIG. 5.

Figure 6:
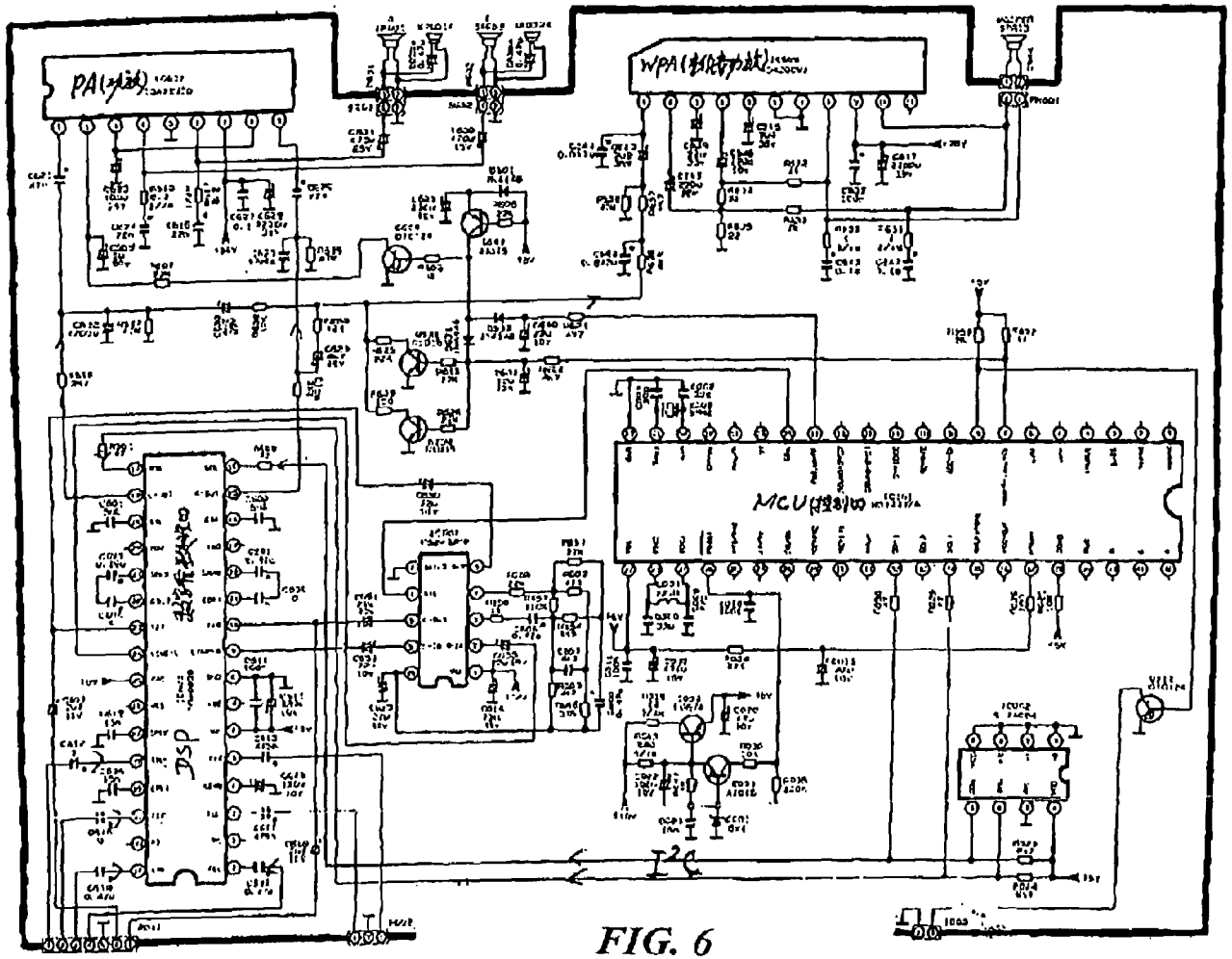
FIG. 6 is a sound circuit of the present invention.

Referring to FIG. 6, it shows the sound circuit of the present invention, which operation is as follows:

1. When a remote controller switches to sound/television mode, microprocessor MCU sets STB register of on-chip processor TDA8841 at 0 through I'C bus, enabling TDA8841 at Standby mode. Then, horizontal drive output is open at pin No. 40 so that horizontal activation stops. To assume horizontal drive stage inactivation, pin No. 8 of microprocessor MCU sends a high level through Q212 to ground the base of transistor for the horizontal drive, resulting in horizontal output level to be cut off, no high-voltage supplied, and finally, operation of scanning circuit is terminated.
2. Microprocessor MCC sets up parameters of sound modes, tenor, bass, and sound volume by digital sound processing chip TDA9859 of $I^2C$ bus. After obtaining proper advance audio signal, stereo power amplifier TDA2616Q and woofer power amplifier TDA2009A are driven. At last 3D space sound field effect such as surrounding stereo sound is reproduced through loudspeaker system.

3. In operation, in order to enable users to choose sound effect on CRT screen by interactive interface, the machine actually implements the second part before performing the first part.

Since only accompanying sound channel works under sound television mode, the 100W power for scanning circuit and high-voltage circuit is saved. Thus, the present invention consumes only about 30W power, which shows that the digital sound television system in accordance with the present invention is a green appliance.

Figure 7:
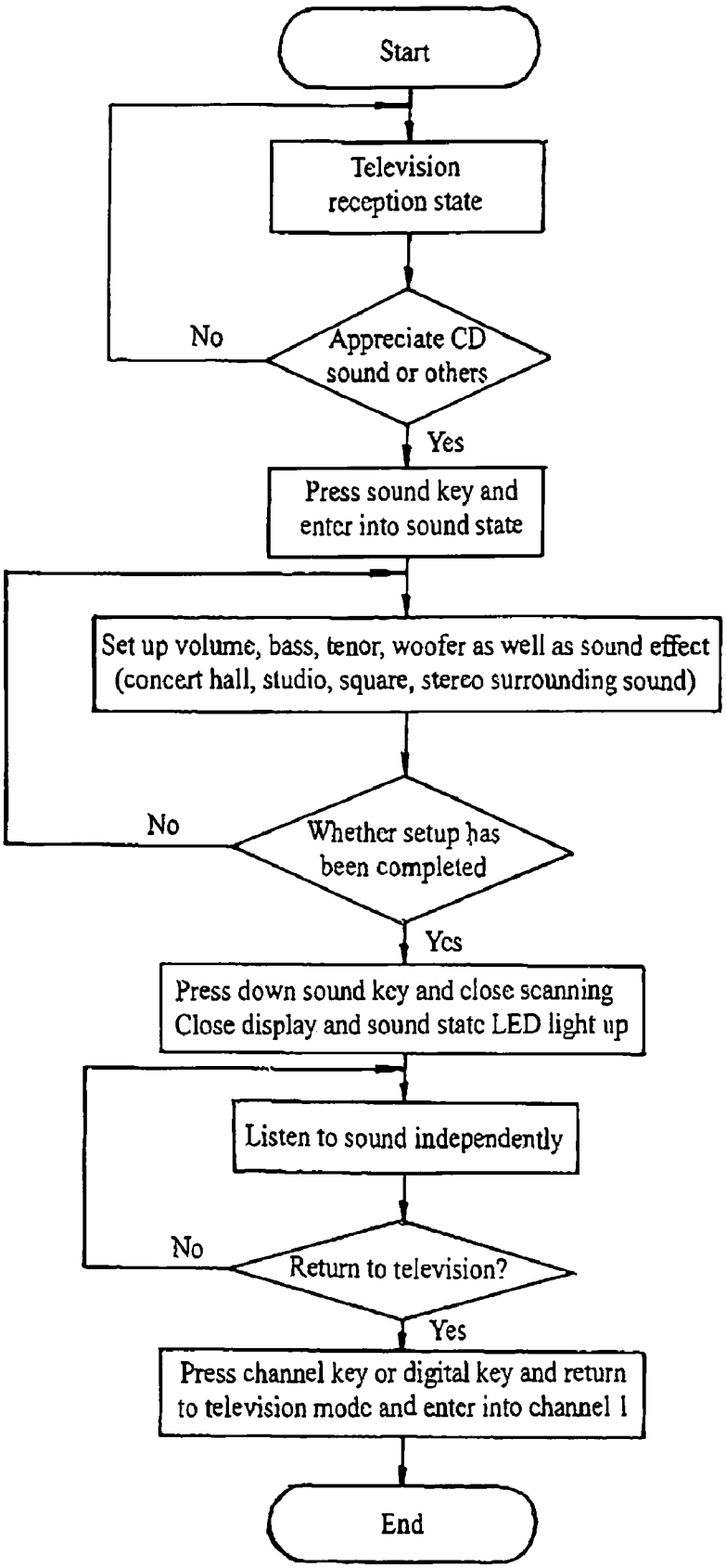
FIG. 7 is a flow chart of the control process in accordance with the present invention.
Figure 1:
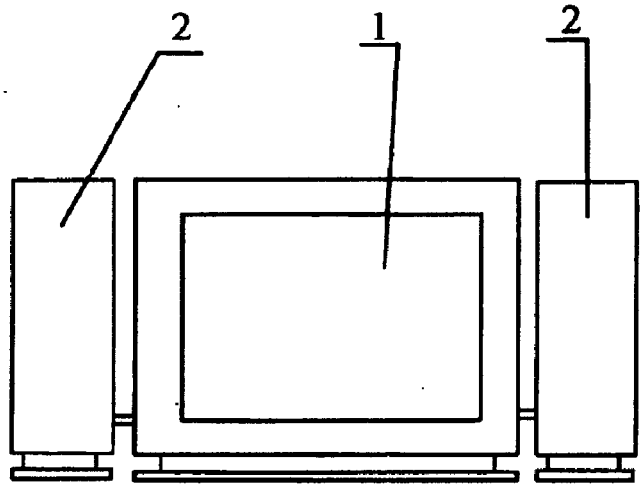
Figure 2:
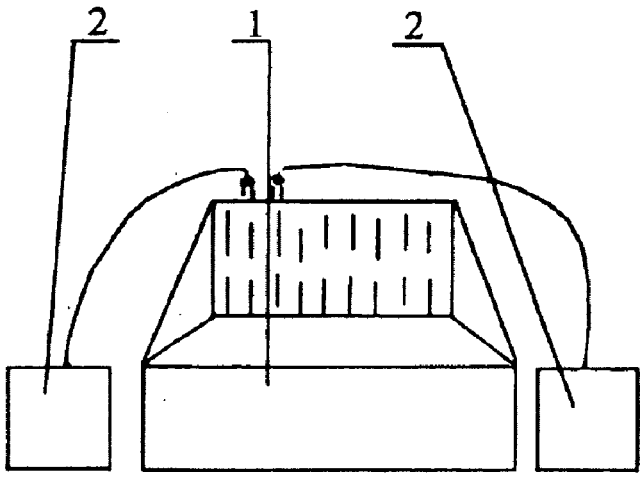
Figure 3:
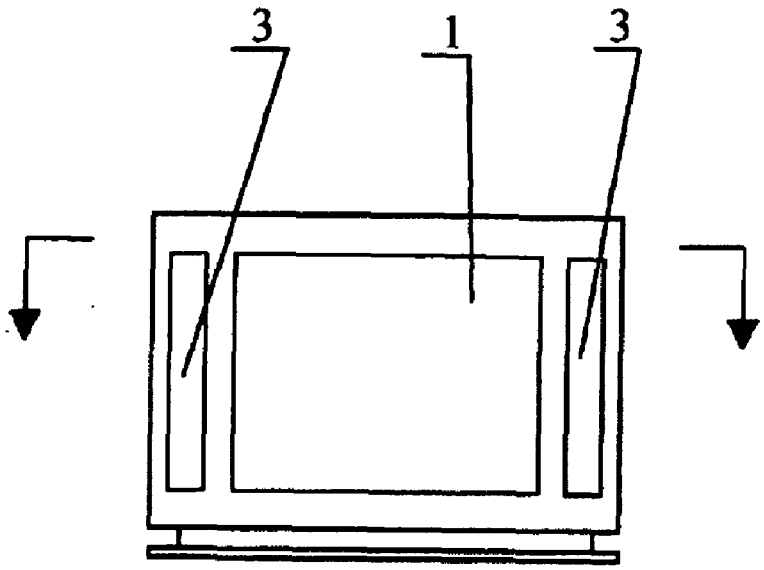
Figure 4:
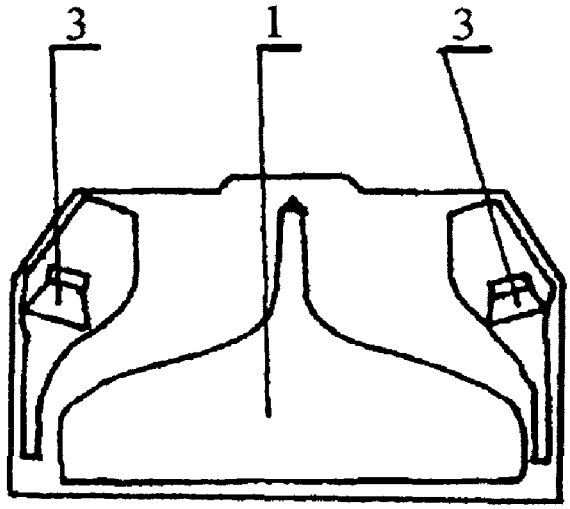
Figure 5:
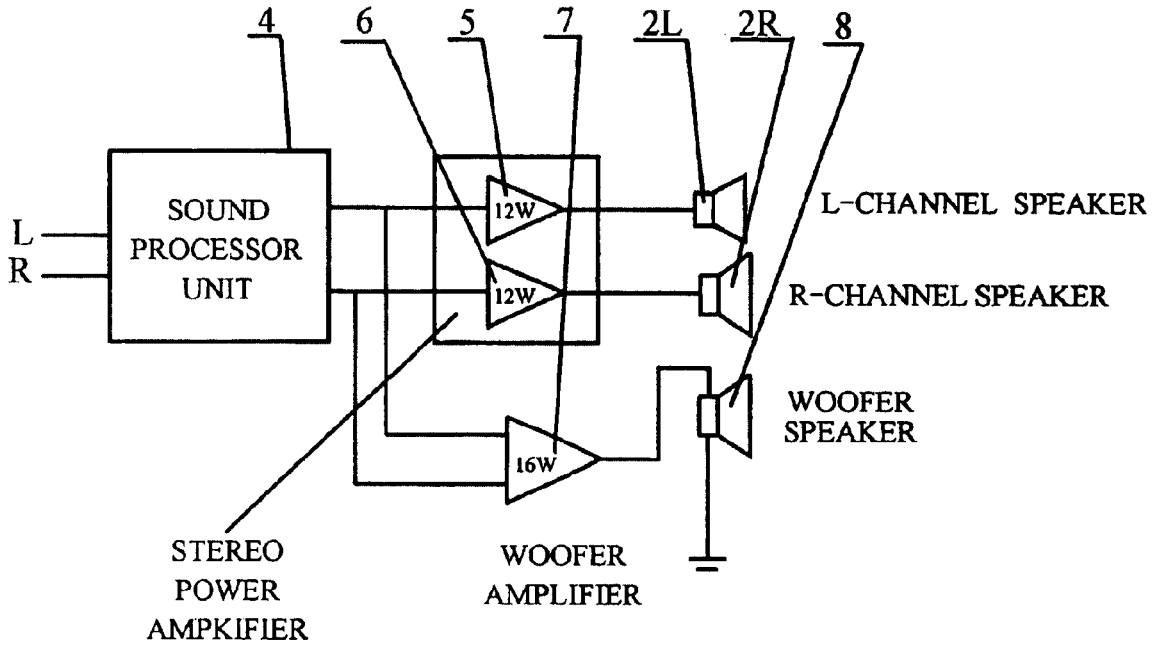
Figure 9:
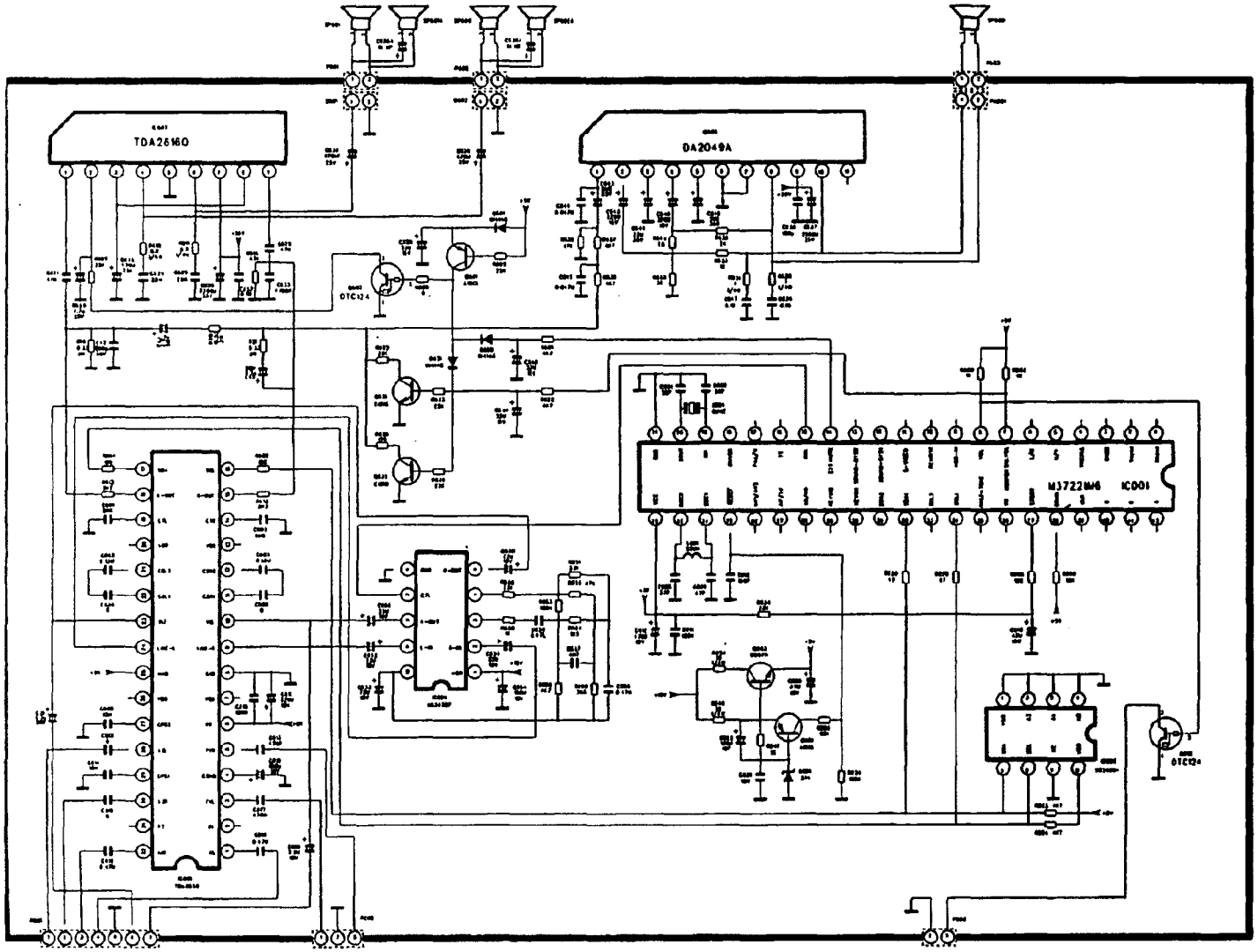
Figure 7:
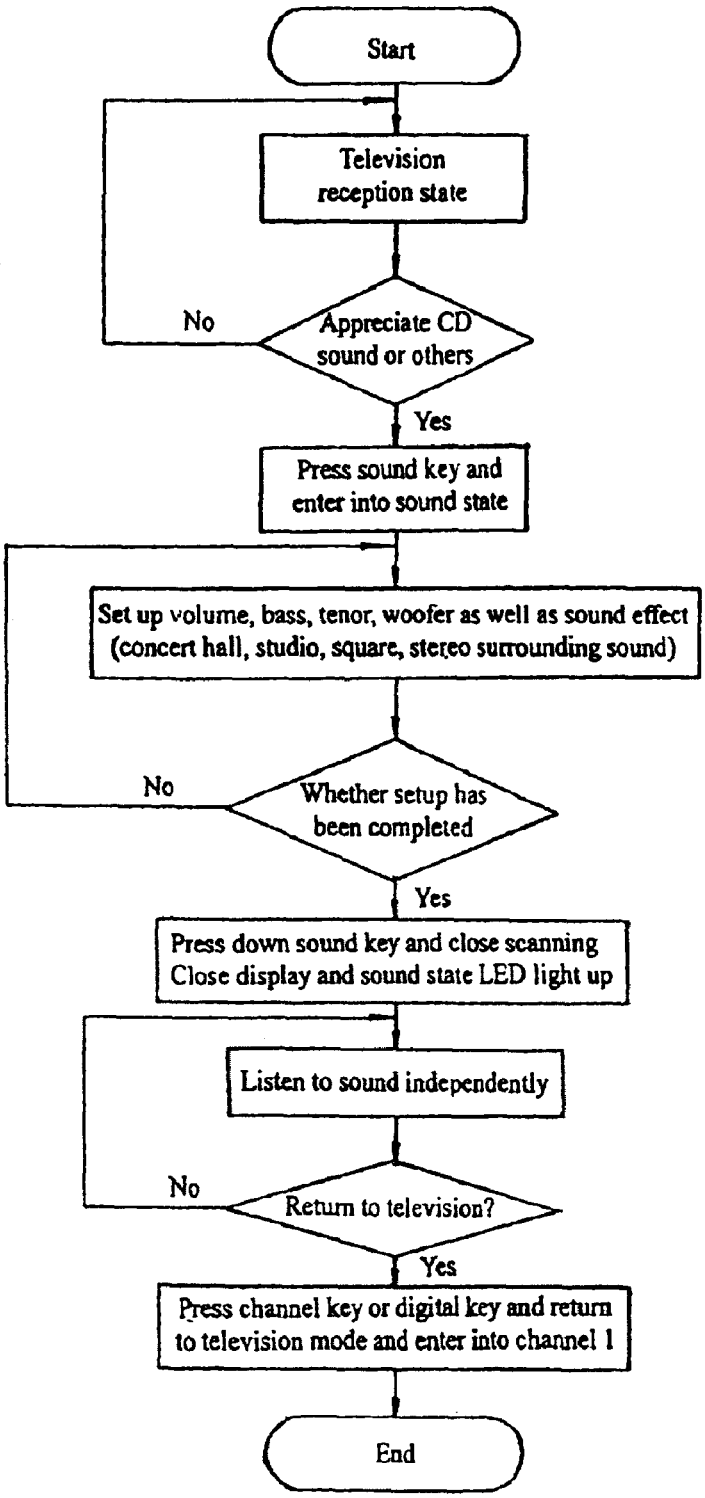

FIG. 7 shows flow chart of the operation in accordance with the present invention. The audio signal source is coupled to the television system in accordance with the present invention and television is tuned on, so the television enters into "television reception state". To appreciate CD sound, "sound key" is pressed to switch the television into sound state mode, then, the menu "sound setup" appears on the screen. Then, users may operate step by step according to directions of the menu (switch automatically to next page of the menu three seconds after). First, audio signal (AYZ) is inputted, then sound parameters including volume, bass, tenor, balance, woofer, and sound effect (concert hall, studio, square, stereo, surrounding sound) are set up. Sound key is pressed for continuously three minutes to close scanning circuit and display circuit. At this time, the television is shut down and "sound state" genuinely comes out; meanwhile, LED indicating sound state lights up. Then, only sound is displayed. Sound volume, effect, and pitch during listening may be adjusted with corresponding keys on the remote controller Then, LED on television lights up as reply. A MUTE key may be pressed to stop listening temporarily. To enter into television state again, press down channel +/− key or digital key on the remote controller. Then, the television system in accordance with the present invention automatically enters into channel 1 to receive and display a television program.

Operation of the television system in accordance with the present invention under television state is identical with that of traditional color television, so its explanation and introduction is not described here.

What is claimed is:

1. A digital sound television system comprising:

a television set including a CRT for displaying a television picture;

a microprocessor unit (MCU) for controlling receiving and displaying of the television picture in response to a user's command;

processing means for processing sound signal; and

CRT scanning means including a horizontal scanning means;

wherein, the microprocessor unit shuts the television picture down in response to a sound command signal by outputting a control signal to ground a base of a transistor for the horizontal scanning means, cutting the horizontal scanning means off, and preventing high voltage from supplying to a second anode of the CRT and the sound signal alone is processed when the television picture displayed by the CRT is shut down.

* * * * *

UNITED STATES PATENT AND TRADEMARK OFFICE

CERTIFICATE OF CORRECTION

PATENT NO. : 6,975,738 B2
APPLICATION NO. : 09/783371
DATED : December 13, 2005
INVENTOR(S) : Fuzhong Yang and Fayong Cai It is certified that error appears in the above-identified patent and that said Letters Patent is hereby corrected as shown below:

Delete all drawings and substitute attached copies of drawings for FIGS. 1, 2, 3, 4, 5, 6, and 7.

Signed and Sealed this

Twenty-seventh Day of June, 2006

JON W. DUDAS
*Director of the United States Patent and Trademark Office*